United States Patent [19]

Moye

[11] Patent Number: 4,754,965

[45] Date of Patent: Jul. 5, 1988

[54] STARTING BLOCK FOR RUNNERS

[76] Inventor: Charles W. Moye, 2591 Robindale, Akron, Ohio 44312

[21] Appl. No.: 856,589

[22] Filed: Apr. 25, 1986

[51] Int. Cl.[4] ..... A63K 3/02

[52] U.S. Cl. ..... 272/105

[58] Field of Search ..... 272/105, 145, 100, 65

[56] References Cited

U.S. PATENT DOCUMENTS

| | | | |
|---|---|---|---|
| 2,004,172 | 6/1935 | Widay | 272/105 |
| 2,937,871 | 5/1960 | McCafferty | 272/105 |
| 3,401,931 | 9/1968 | McCafferty et al. | 272/105 |
| 3,799,542 | 3/1974 | Potgieter | 272/105 |
| 4,089,519 | 5/1978 | Newton, Jr. | 272/105 |

OTHER PUBLICATIONS

Hadar Manufacturing Co. (ad in Sporting Goods Dealer); p. 431; Jan. 1972.

*Primary Examiner*—Richard J. Apley

*Assistant Examiner*—Howard Flaxman

*Attorney, Agent, or Firm*—Renner, Kenner, Greive, Bobak & Taylor

[57] ABSTRACT

A starting block (10) for a runner to be used on a track having running lanes extending from a starting line (L) to a finish line including, a frame (11) for positioning in alignment with a running lane proximate to the starting line (L), fasteners (22) for maintaining the frame at a selected location on the track, a front pad (55) selectively attachable longitudinally of the frame and having a substantially horizontal surface (56) for supporting one foot of a runner in a standing position, and a rear pad (30) selectively attachable longitudinally of the frame and having an angularly upwardly extending surface (31) for engagement by the other foot of a runner in a standing position to assist in thrusting the runner across the starting line (L) in a running lane toward the finish line.

17 Claims, 2 Drawing Sheets

STARTING BLOCK FOR RUNNERS

TECHNICAL FIELD

The present invention relates generally to starting blocks used to achieve fast acceleration in certain running events of track and field competition. More particularly, the present invention relates to a starting block which is designed to optimize a runner's acceleration from the starting line from a standing position. More specifically, the invention relates to a starting block which is adapted to receive a runner's feet in a standing start position and provides suitably angled and tractioned surfaces to optimize a runner's acceleration from such an erect, standing position.

BACKGROUND ART

Starting blocks of various types have long been employed in competitive track and field activities. The use of starting blocks is of primary significance in relatively short distance sprinting and hurdling events where the elapsed time of a race is a matter of seconds and where differences in the performance of different runners is frequently measured in small fractions of a second.

The general configuration and the method of employing starting blocks has remained essentially the same for many decades. The accepted theory for optimum acceleration at the start of a race has proceeded on the premise that a runner should be in a crouched position with both hands positioned on the ground at approximately shoulder width in close proximity to the starting line of a racing lane with one leg beneath the body and with that foot being in substantially closer proximity to the starting line than the other leg and foot which are extended rearwardly at the commencement of the running event. The forward foot has the leg severely bent under the runner in the preparatory position. The leg displaced from the starting line has the knee positioned on the ground in the preparatory position to afford stability and a degree of comfort in the crouched preparatory position. In the subsequent set position, which takes place instantaneously prior to commencement of the race, the runner shifts his body weight forwardly to transfer greater weight to the hands, to raise the knee of the rearward foot off the ground and to prepare to push outwardly across the starting line in the crouched position from starting block pads or pedals which are positioned rearwardly of the runner's feet in the preparatory and set positions.

The runner is trained to slowly right his body from the crouched position with the back nearly horizontal or parallel to the ground to the upright running position gradually over a number of strides. This theoretically minimizes the effort necessary to overcome gravity in righting the body while minimizing the possibilities of losing balance or interfering with the runner's stride during the transition between the crouched starting and upright running positions.

For employing the crouched position start conventional starting blocks have classically consisted of a pair of blocks or other upright members which are attached to the track such as to resist rearward displacement when a runner applies pressure thereto in an effort to accelerate across the starting line. While such blocks may originally have consisted of mere mounds of dirt or individual block elements attached to the track as by a spike, for a number of years starting blocks have consisted of an integrated unit having a central longitudinal frame to which two pedals or pads are attached. Normally the pedals are essentially identical except that one is adapted to engage one side of the central frame while the other is adapted for attachment to the other side of the central frame. Normally the pedals can be positioned at any desired location longitudinally of the frame in order that a pedal may support either foot as the advanced foot in the crouched starting position with the other pedal being appropriately rearwardly positioned for support of the other foot of the runner.

Beyond these common features running block improvements have been only in the nature of refinements, generally of a very minor nature. For example, the upright foot engaging surfaces have been positioned at different angles to the horizontal. In other instances, the pedals have been provided with structure permitting independent variable angular positioning of the foot engaging surfaces. In other instances pedals of different widths have been provided to require or to accommodate different width stances in the crouched starting position. In other instances, longer upstanding foot engaging surfaces of the pedals have been employed to engage or contact more than the ball of the runner's foot, as for preventing the rolling back of a runner's heel as a reaction to the start of a race.

Although the acceptance of the crouched starting theory and the starting blocks created therefor have been nearly unanimous in competitive circles for many years, there are recent indications of departures from this theory. Applicant and perhaps others are of the belief that a runner may be capable of accelerating to optimum speed and positioning in a shorter time and with less energy expenditure from a standing start position. While conventional starting blocks may be employed to afford some assistance in effecting a standing start, these standard blocks may not afford the optimum basis for acceleration from a standing start position.

DISCLOSURE OF THE INVENTION

Therefore, an object of the present invention is to provide a starting block which makes it possible to execute a starting movement for races from a standing position to eliminate the significant and compound stresses upon a runner's leg muscles during the transition from a crouched to an upright running position. Another object of the present invention is to provide starting blocks for a standing start which virtually immediately positions a runner in an optimum running position. A further object of the invention is to provide a starting block for a standing start wherein the runner's rear foot may be thrust into engagement with the rear block so that the opposite reaction propels or accelerates the runner outwardly from the starting line in a running position.

Yet another object of the invention is to provide a starting block for a standing start which eliminates the necessity for overcoming gravity in raising the body as is required in a conventional crouched start. A still further object of the invention is to provide a starting block wherein injuries may be reduced during races and practices due to the elimination of the severely bent leg position which is necesitated in the crouched start. Still another object of the invention is to provide a starting block wherein additional practice starts may be undertaken due to the fact that the leg muscle fatigue necessarily associated with the crouched start is obviated such that runners may become more proficient in perfecting the starting movement.

Yet another object of the invention is to provide a starting block for a standing start which may be positioned such that the foot pads are substantially closer to the starting line than is possible when employing a crouched start such that the runner commences the race with a distance advantage of a step or a substantial portion thereof. Another object of the invention is to provide a starting block wherein the runner may be initially positioned in essentially a running position of the arms, legs and torso to provide comfort, as well as a minimum of transition to full speed running. Yet another object of the invention is to provide a device which optimizes traction during a standing start while providing extreme comfort and flexibility in the preparatory or ready and the set positions prior to starting.

A still further object of the invention is to provide a starting block which can be readily adjusted and otherwise adapted for runners having different stances and preferences in regard to the standing start position. A still further object of the invention is to provide a starting block which is relatively noncomplex, durable and can be safely and effectively employed by runners having diverse skill levels or runners with minor physical injuries or limitations.

In general, a starting block for a runner to be used on a track having running lanes extending from a starting line to a finish line includes, a frame for positioning in alignment with a running lane proximate to the starting line, a fastener for maintaining the frame at a selected location on the track, a first pad selectively attachable longitudinally of said frame and having a substantially horizontal surface for supporting one foot of a runner in a standing position, and a second pad selectively attachable longitudinally of the frame and having an angularly upwardly extending surface for engagement by the other foot of a runner in a standing position to assist in thrusting the runner across the starting line in a running lane toward the finish line.

PREFERRED EMBODIMENT FOR CARRYING OUT THE INVENTION

Figure 1:
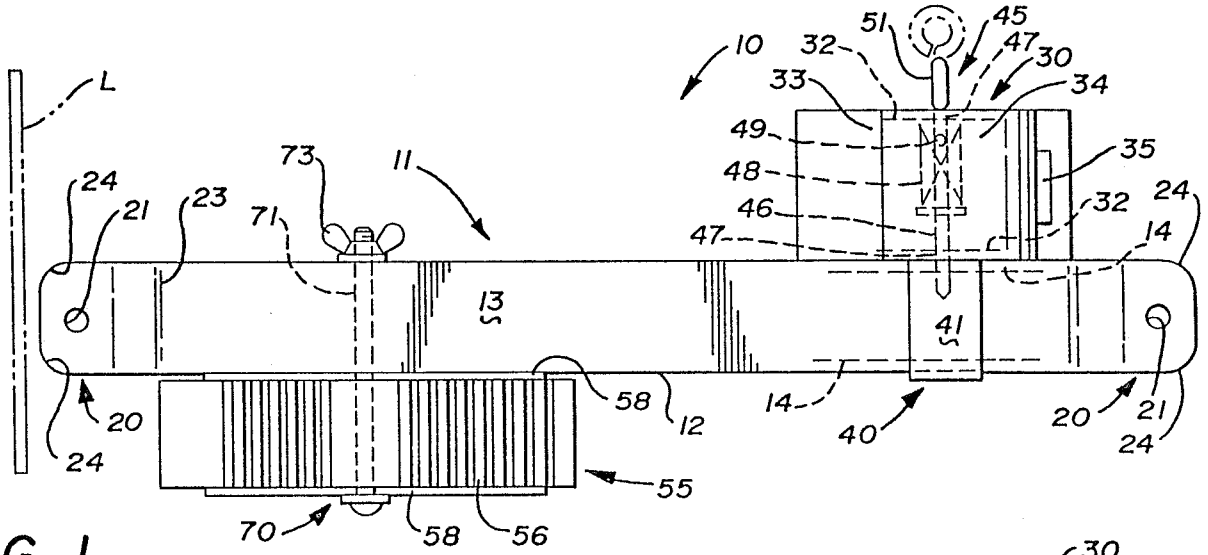
FIG. 1 is a top plan view of an exemplary starting block embodying the concepts of the present invention positioned for utilization by a runner in a standing position proximate to the starting line of a running lane.

A starting block for a runner according to the concepts of the present invention is generally indicated by the numeral 10 in the drawing figures. As shown for exemplary purposes, the starting block 10 may be positioned in close proximity to a starting line L of a group of racing lanes. In this respect, it is to be appreciated that a conventional block for use by a runner employing the conventional crouched position would need to be positioned a substantial distance to the right as viewed in FIG. 1 in order to accommodate the horizontal extension of the trunk and rearwardly projecting leg of a runner to effect the necessary positioning of the runner's hands behind the starting line L.

As shown, the starting block 10 has as the main longitudinal member aligned with the running lane and preferably positioned substantially perpendicular to the starting line L, a main frame or bar assembly, generally indicated by the numeral 11. Although the frame 11 may take various forms, as exemplified by prior art devices, the frame shown has a medial portion 12 of generally rectangular configuration. As shown, the medial portion 12 may be a generally U-shaped member having a uniform planar upper surface 13 with a projecting flange 14 extending from either lateral extremity thereof (see FIG. 2). The medial portion 12 is provided with structure for attachment of foot supporting elements, as described hereinafter, as by receivers, generally indicated by the numeral 15, which are positioned on the flanges 14 but could be otherwise positioned laterally of the upper surface 13 or otherwise on the flanges 14 in manners well known to persons skilled in the art. As shown, the receivers 15 constitute a plurality of bores 16 extending substantially the length of the medial portion 12 of frame 11 for a purpose to be hereinafter described.

The extremities of the medial portion 12 of frame 11 terminate in attachment elements, generally indicated by the numeral 20. As shown, each of the attachment elements 20 consists of a reduced thickness generally rectangular area which has a bore 21 for receiving fasteners such as the spikes 22 depicted in FIG. 2 which extend a substantial distance below frame 11 for purposes of insertion into the ground or a track surface to maintain the starting block 10 temporarily affixed to the ground at a desired position and in a manner which is particularly adapted to resist forces applied longitudinally of the frame 11. A greater number of smaller or other arrangements of fastening devices known in the art could be employed.

In order to avoid sharp corners which could possibly injure a user of the starting block 10, the transition between the medial portion 12 and the attachment elements 20 may be a curved surface 23. Similarly the longitudinally outward extremities of the attachment elements 20 may have rounded corners 24 to minimize the risk of injury to a runner.

Positioned laterally of the frame 11 is a rear pad, generally indicated by the numeral 30, which is displaced longitudinally of the frame 11 a substantial distance from the starting line L. As shown, the rear pad 30 is for accommodating the right foot of a runner positioned on the starting block 10 with the right foot displaced rearwardly of the left foot as a matter of starting preference. The rear pad 30 may be a generally hollow triangular member having an upstanding supporting surface 31. The rear pad 30 has triangular webs 32 which support and rigidify the supporting surface 31 at each lateral extremity thereof. Constructed as a portion of the supporting surface 31 or as an extension thereto, an extension surface 31' is provided so that the surfaces 31, 31' provide an area of a size to accommodate the length and width of a runner's foot. As shown, the surfaces 31, 31' are positioned at an angle of approximately 45° to the ground or track upon which the starting block 10 is positioned. It is to be appreciated, however, that deviations on the order of 10° or 15° or more in either direction may produce equivalent results or may even be preferred by particular runners. In this respect it is to be understood that the surfaces 31, 31' provide the primary element at the instant of start against which the rear foot is thrust so that the opposed reaction of the rigid rear pad 30 propels or accelerates the runner outwardly from the starting block 10 across the starting line L.

Preferably a substantial portion of the surfaces 31, 31' may be covered with a hard elastomeric cover 33 which provides good traction for the outer sole or the spikes of a track shoe. Due to the extreme forces which may be developed in thrusting against the surfaces 31, 31', a pad 34 of resilient material may be applied over all or, as shown, an upper, rear portion of the cover 33. Such a pad 34 may be significant in reducing the possibility of heel bruises or other injury, particularly in the conduct of repeated starts. If an extended surface 31' is employed as depicted in FIGS. 1 and 2 of the drawings, a vertical support plate 35 may be employed for purposes of rigidifying the upper rearward extremity of the surface 31'.

The rear pad 30 is rigidly positioned in relation to the frame 11 as by a clamping bar, generally indicated by the numeral 40. As shown, the clamping bar 40 is a laterally projecting L-shaped member which is rigidly attached to the interior triangular side web 32. The clamping bar 40 has a laterally projecting leg 41 which overlies the upper surface 13 of the frame 11. The extremity of leg 41 has a downwardly projecting leg 42 which overfits flange 14 of the frame 11 to maintain the rear pad 30 in close proximity to and in projecting perpendicular alignment to the frame 11.

Figure 2:
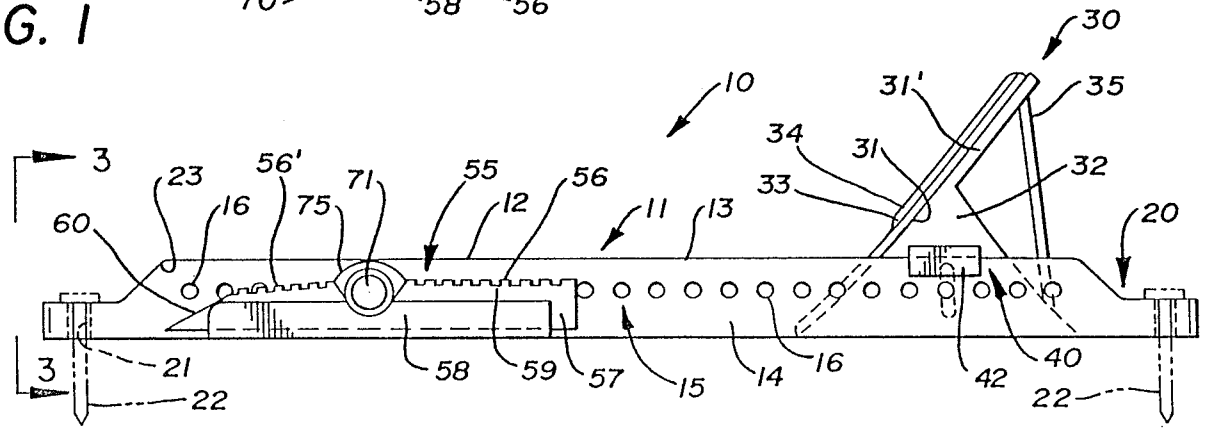
FIG. 2 is a side elevational view of the starting block of FIG. 1 depicting details of the foot supporting pads and the attachment of the foot pads to the central frame of the starting block.
Figure 3:
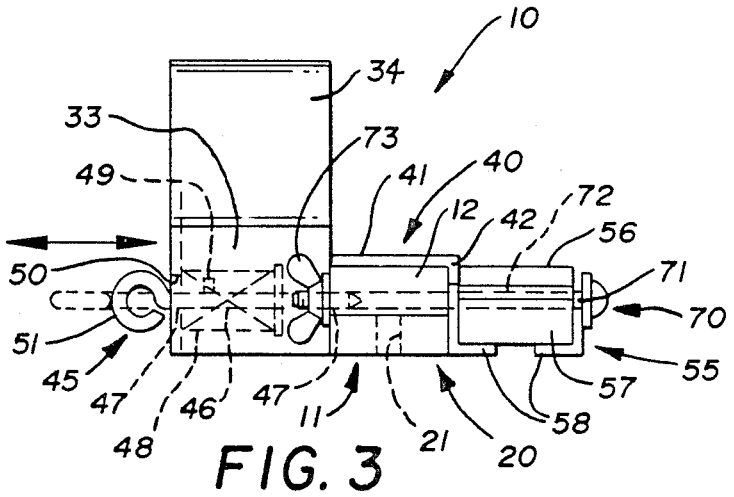
FIG. 3 is an end elevational view taken substantially along the line 3—3 of FIG. 2 and showing additional details of the foot pads and the attachment of the foot pads to the central frame of the starting block.

The rear pad 30 is maintained at a selected location longitudinally of the frame 11 by a locking assembly, generally indicated by the numeral 45, as best seen in FIGS. 1 and 3. The locking assembly 45 has a locking rod 46 which extends through alignment holes 47 in laterally opposed positions on the webs 32. The rod 46 is of sufficient length to extend into one of the bores 16 of the receiver 15 of the frame 11. As will be apparent to persons skilled in the art, any one of the bores 16 depicted in FIG. 2 may be employed to achieve the desired position of rear block 30 relative to the frame 11. The locking pin 46 resides in the solid line position depicted in FIGS. 1 and 3 when extended into a bore 16. The locking rod 46 may be retracted from a selected bore 16 for repositioning block 30 longitudinally of the frame 11 by pulling it outwardly against the compression of a spring 48. In this retracted position the rod 46 no longer extends through a bore 16.

The rod 46 may be provided with a latch pin 49 which resides outside the outer web 32 when the pin is in the withdrawn position. The outer web 32 is provided with a slot 50 through which the latch pin 49 passes in moving the locking rod 46 between the retracted and extended positions. The locking rod 46 may be provided with a curved handle 51 at its outward extremity for purposes of facilitating movement between the extended and retracted positions and effecting rotation for the purpose of bringing the latch pin 49 into and out of coincidence with the slot 50.

Positioned laterally of the frame 11 closer to the starting line L than rear pad 30 and to the other side of the frame 11, is a front pad, generally indicated by the numeral 55. As seen in the drawings the front pad 55 differs substantially from the rear pad 30 in being a generally rectangular block having a substantially horizontal upper surface 56 which is substantially parallel to the track. The front pad 55 may be a substantially rectangular block 57 which may be of an elastomeric material such as a hard rubber. The block 57 is engaged and firmly positioned on the surface of the track by a pair of L-shaped holders 58 which engage the sides and preferably a portion of the lower surface of the block 57. The upper surface 56 of the block 57 may advantageously have spaced transverse grooves 59 for purposes of providing an irregular surface to improve gripping by a runner's foot. The front portion 56' of block 57 may taper downward slightly, as shown, for purposes of increasing traction with a runner's foot.

The forward edge of the block 57 has a slanted face 60 adapted to engage a portion of the front half of a runner's foot. As shown, the slanted face 60 may be at an angle of approximately 30° with respect to the track; however, other shallow angles or a slowly tapering curvilinear face to which a runner's foot comfortably conforms may be employed successfully. Being the secondary area to which pressure is applied subsequent to the moment of start, i.e., after pressure is applied by the rear foot to the rear pad 30, the forward portion of block 57 with slanted face 60 and surface 56' engage all of the foot, except for the first three or four inches which are extended along the slanted face 60 and onto the track surface. The forward portion of block 57 is thus configured in such a manner as to provide nonslipping stability and balance sufficient for a controlled secondary push to supplement the primary thrust developed from the rear foot engaging the rear pad 30.

The front pad 55 is detachably secured to the frame 11 as by an attachment assembly, generally indicated by the numeral 70. As shown, the attachment assembly 70 has an attachment rod 71 which extends through a bore 72 in the front pad 55. The attachment rod 71 is adapted to extend through bores 16 of the receivers 15 of the frame 11 and to receive a fastener 73 such as the conventional wing nut shown. It is to be appreciated that the attachment assembly 70 permits the assembly of the pad 55 to either side of the frame 11. As shown, the rectangular block 57 may be provided with a raised curved portion constituting a mounting collar 75 for the rod 71. The collar 75 is depicted substantially medially of the block 57 and thus located may be employed as a central arch supporting portion of the block 57, which may be employed by a runner to support the leading foot during preparatory stages of a start sequence. It is to be noted that the position of block 57, collar 75 and the holes 16 are such that when rod 71 is attached through the hole 16 of frame 11, the lower surface of the L-shaped holders 58 are in engagement with the surface of the track so that the front pad and particularly the upper surface 56 provide a stable, firmly seated platform for a runner's leading foot.

The starting block 10 can readily be constructed of various metals, appropriately selected plastics or combinations of materials as will be appreciated by persons skilled in the art, with the exception of the preferred use of elastomeric or resilient members herein specifically suggested. It is also to be appreciated that various devices for attaching pads to a central frame or bar could be adapted from devices known to persons skilled in the art. As will also be apparent to persons skilled in the art modifications can be made to the preferred embodiment disclosed herein, such as particular dimensions, or spacing of the pads, without departing from the spirit of the invention, the scope of the invention being limited solely by the scope of the attached claims. It should also be evident that the starting block disclosed herein carries out the various objects of the invention set forth hereinabove and otherwise constitutes an advantageous contribution to the art.

I claim:

1. Starting block apparatus for a runner to be used on a track having running lanes extending from a starting line to a finish line comprising, frame means for positioning in alignment with a running lane proximate to the starting line, fastener means for maintaining said frame means at a selected location on the track, first pad means selectively attachable longitudinally of said frame means and having a substantially horizontal surface for supporting the front foot of a runner in a standing position, said first pad means having a slanted face at the forward edge thereof for engagement by the front portion of the front foot of a runner, and second pad means selectively attachable longitudinally of said frame means and having an angularly upwardly extending surface for engagement by the rear foot of a runner in a standing position to assist in thrusting the runner across the starting line in a running lane toward the finish line.

2. Apparatus according to claim 1, wherein said slanted face is positioned at an angle of approximately 30° with respect to the track.

3. Apparatus according to claim 1, wherein said horizontal surface has tread means to resist slippage of the front foot in a direction longitudinally of said frame means.

4. Apparatus according to claim 3, wherein said tread means consists of grooves disposed laterally of said horizontal surface.

5. Apparatus according to claim 4, wherein said horizontal surface is of an extent substantially equivalent to the length of a runner's foot.

6. Apparatus according to claim 1, wherein said angularly upwardly extending surface of said second pad means is at an angle of approximately 45° to the track.

7. Apparatus according to claim 1, wherein said second pad means is of an extent sufficient to engage substantially the entire length and width of a runner's foot.

8. Apparatus according to claim 7, wherein said angularly upwardly extending surface has padding over at least a portion thereof to reduce shock to the rear foot of a runner.

9. Apparatus according to claim 1, wherein said frame means has a plurality of receiver means extending longitudinally thereof for selective attachment of said pad means.

10. Apparatus according to claim 9, wherein said pad means have rods for engaging said receiver means.

11. Apparatus according to claim 10, wherein said rods are selectively locked in selected ones of said receiver means.

12. Apparatus according to claim 10, wherein one of said rods extends through a collar formed in said first pad means.

13. Apparatus according to claim 1, wherein said fastener means are elements extending from the bottom of said frame means into engagement with the track.

14. Apparatus according to claim 13, wherein said fastener means are elongate spikes for penetrating the track.

15. Starting block apparatus for a runner to be used on a track having running lanes extending from a starting line to a finish line comprising, frame means for positioning in alignment with a running lane proximate to the starting line, fastener means for maintaining said frame means at a selected location on the track, first pad means selectively attachable longitudinally of said frame means and having a substantially horizontal surface for supporting the front foot of a runner in a standing position, said first pad mean including a substantially rectangular block having an upper surface including said horizontal surface and having a slanted face at the forward edge of said rectangular block for engagement by the front portion of the front foot of a runner, and second pad means selectively attachable longitudinally of said frame means and having an angularly upwardly extending surface for engagement by the rear foot of a runner in a standing position to assist in thrusting the runner across the starting line in a running lane toward the finish line.

16. Apparatus according to claim 15, wherein said horizontal surface has a front portion which tapers downward slightly for increasing traction with the front foot of a runner.

17. Apparatus according to claim 15, wherein said slanted face is positioned at an angle of approximately 30° with respect to the track.

* * * * *